United States Patent [19]

Arterbury et al.

[11] Patent Number: 4,770,336

[45] Date of Patent: Sep. 13, 1988

[54] WELL SCREEN CENTRALIZER AND METHOD FOR CONSTRUCTING CENTRALIZER AND FOR JOINING OF WELL SCREENS

[75] Inventors: Bryant A. Arterbury; James E. Spangler, both of Houston, Tex.

[73] Assignee: Howard Smith Screen Company, Houston, Tex.

[21] Appl. No.: 37,335

[22] Filed: Apr. 13, 1987

Related U.S. Application Data

[62] Division of Ser. No. 839,955, Mar. 17, 1986, Pat. No. 4,681,161.

[51] Int. Cl.[4] ..... B23K 31/00; E21B 19/16

[52] U.S. Cl. ..... 228/182; 228/213; 166/227; 166/235; 166/241; 166/380; 175/325

[58] Field of Search ..... 228/182, 212, 213, 44.5, 228/49.3; 166/227–236, 241, 242, 380; 175/325

[56] References Cited

U.S. PATENT DOCUMENTS

| | | | |
|---|---|---|---|
| 2,150,450 | 3/1939 | Maloney | 166/5 |
| 2,167,338 | 7/1939 | Murcell | 228/182 |
| 2,188,119 | 1/1940 | Prentice | 166/4 |
| 2,248,834 | 7/1941 | Thomas | 166/5 |
| 2,259,023 | 10/1941 | Clark | 228/182 |
| 2,371,391 | 3/1945 | Haynes | 166/5 |
| 2,728,399 | 12/1955 | Kluck | 166/241 |
| 2,804,926 | 9/1957 | Zublin | 166/235 |
| 2,896,714 | 7/1959 | Killingsworth | 166/15 |
| 3,094,852 | 6/1963 | Taylor | 166/77.5 |
| 3,193,918 | 7/1965 | Heldenbrand | 228/182 |
| 3,420,309 | 1/1969 | Beylik | 166/242 |
| 3,981,359 | 9/1976 | Fortenberry | 166/241 |
| 4,209,066 | 6/1980 | Watson | 166/380 |
| 4,284,138 | 8/1981 | Allred | 29/458 |
| 4,506,730 | 3/1985 | McCollin et al. | 166/85 |
| 4,509,600 | 4/1985 | Boudreaux et al. | 166/85 |
| 4,693,318 | 9/1987 | Petrovic | 166/380 |

FOREIGN PATENT DOCUMENTS

| | | | |
|---|---|---|---|
| WO83/03443 | 10/1983 | PCT Int'l Appl. | 166/380 |

*Primary Examiner*—Nicholas P. Godici
*Assistant Examiner*—Samuel M. Heinrich
*Attorney, Agent, or Firm*—Dennis T. Griggs

[57] ABSTRACT

A well screen centralizer with a longitudinal flow passage therethrough which has a well screen insert that increases the producing area of the well screen by reducing the amount of blank non-producing tubing length usually used to accommodate non-well screen insert centralizers. A method for constructing a well screen centralizer and a method for inserting well screens into a well bore that includes welding the couplings to the well screens and using a well screen assembly and support stand.

4 Claims, 1 Drawing Sheet

WELL SCREEN CENTRALIZER AND METHOD FOR CONSTRUCTING CENTRALIZER AND FOR JOINING OF WELL SCREENS

CROSS REFERENCE TO RELATED APPLICATION

This is a divisional of U.S. Application Ser. No. 839,955 filed Mar. 17, 1986, now U.S. Pat. No. 4,681,161.

BACKGROUND OF THE INVENTION

1. Field of the Invention

This invention relates to centralizers for well screens. This device provides a centralizer with a longitudinal flowpath therethrough that reduces blank, non-producing tubing sections by adding more screen area. The methods relate to constructing the centralizer and for joining well screens.

2. Description of Related Art

In the past, various approaches to centering well screen tubing in a well bore have been used. The "spring steel" type of centralizers were among the first devices used. An example of this centralizer is shown on pages 7662–66 in Volume 4 of the 1985–86 Edition of the Composite Catalog of Oil Field Equipment and Services by WORLD OIL. These centralizers were clamped to the blank or non-well screen sections by one end of the centralizer and expanded and contracted up and down a short length of the outside diameter of the tubing as the tubing traveled in the well bore. Due to the light, springy nature of these devices, when they were used in deviated well bores, they had a tendency to collapse under the tubing weight allowing the tubing to drag along the side of the well bore and to become decentralized. When withdrawn from the well bore along with the well screen, these spring steel centralizers often displayed a tendency to "ball up" inside washover pipe used to retrieve well screens.

Other centralizers used on well screen tubing consist of usually four or more blade-like projections welded on blank tubing sections. These type of centralizers require that the well screen section be interrupted by blank tubing inserts varying in length from six inches to one foot. Depending on the deviation of the well bore, two or more of these sections may be required to center the well screen properly, thus reducing the producing area of the well screen tubing considerably.

Some centralizers are designed to be clamped onto blank tubing sections or to well screen sections and are usually two pieces bolted together to clamp around the outside circumference of the blank tubing or well screens. This type usually has four or more fin-like projections either welded on or molded into the body of the centralizer. An example of this type is shown in U.S. Pat. No. 3,981,359 by Dewitt L. Fortenberry and assigned to UOP, Inc. The present invention has neither a pair of identical housings nor the fastener members to keep the two sections together as shown. U.S. Pat. No. 4,284,138 by Richard E. Allred and assigned to UOP, Inc. shows a coated screen jacket that could include a finned centralizer welded to the tubing base. Allred's centralizer is welded to a blank tubing portion of the well screen. This device is used to reduce the expense of using stainless steel by using a coated low cost steel.

None of the above address the decrease in flow experienced by placing centralizers in a string of well screens. The present invention, unlike the above patents, increases the available flow area of the well screen tubing while allowing the use of centralizers.

The blades of the present invention also add to the structural integrity of the centralizer.

A method and apparatus for joining well screens is described in U.S. Pat. No. 4,509,600 by Harry J. Boudreaux et al. and assigned to UOP, Inc. which, according to the Summary of the Invention, requires that a boss ring be attached to the well screens in order to support the well screen while the well screens are being joined to another length of well screen tubing. The present invention does not require the step of attaching a boss ring nor using the boss ring to support the well screen tubing. The boss ring is further described but not claimed in U.S. Pat. No. 4,506,730 by Chris D. McCollin, et al. which was assigned to UOP, Inc.

BRIEF SUMMARY OF THE INVENTION

In the running of well screen tubing into drilled holes such as used in oil, gas and water wells, it is often necessary to place centralizers on the well screen at selected locations to prevent the screens from being abraded against the side of the drilled hole and to assist in guiding the well screen through the drilled holes especially if the drilled holes deviate in directions to any appreciable extent. Most centralizers accomplish this by having radial projections of similar diameter extending from the centralizer body. These centralizers are placed on blank, non-screened tubing sections and add to the total length of non-producing tubing area, thus reducing production of oil, gas or water for a given length of well screen tubing placed in the well bore.

This invention also includes a method for constructing the well screen centralizers by integrally forming the rings and the fins in one piece such as casting or by welding the fins to the rings and either inserting the well screen inserts before or after the fins are secured to the rings if the rings and fins are not formed in one piece. A method of installing well screens in a well using a well screen tubing assembly and support means is claimed.

The present invention provides a centralizer that has well screen inserts and increases the production area of the well screen while providing guidance and support.

It is therefore one object of this invention to provide a centralizer that will provide maximum flow into the well screen tubing across the producing zone by not interrupting the screen sections with excess non-producing blank tubing sections.

Another object of the invention is to reduce premature gravel bridging due to dead zones caused by the blank tubing sections of centralizers without well screen inserts.

A further object of this invention is to provide a centralizer that will reduce blank tubing sections that are often eroded by the sandblast effect of fluid flow striking the blank tubing sections instead of entering the well screen.

It is yet another object to provide frequent centralizers for centralization of the well screens in deviated well bores without sacrificing well screen area.

It is a further object of this invention to provide a method of constructing a well screen centralizer.

Another object of this invention is to provide a method for inserting well screens into a well bore using a well screen tubing assembly and support means.

DESCRIPTION OF THE PREFERRED EMBODIMENT

Figure 1:
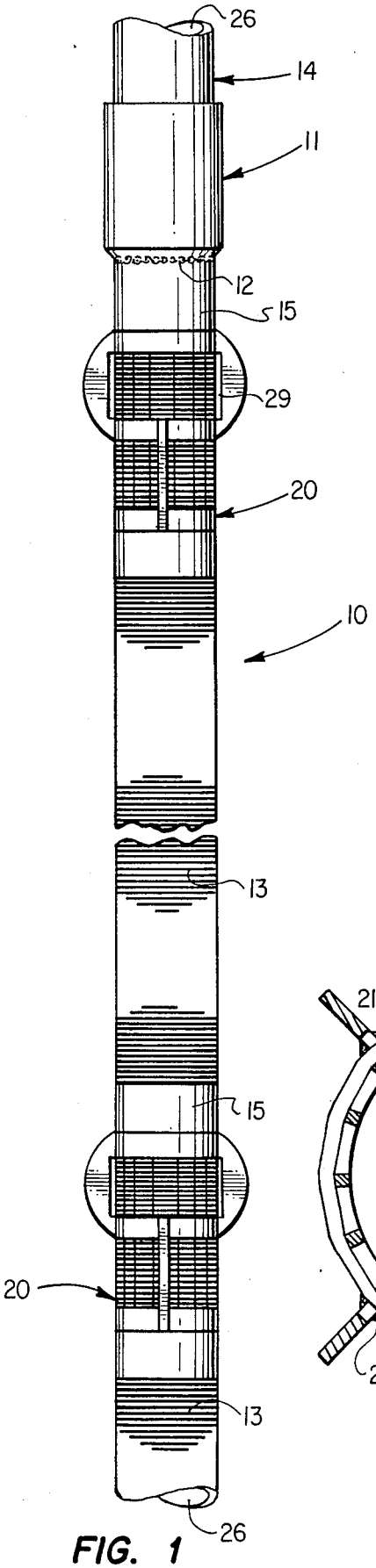
FIG. 1 is a schematic view showing the well screen centralizer in place as a part of a well screen. The view shows a coupling and a second length of tubing connected to the well screen.

Referring to FIG. 1, it will be seen that a well screen 10 is schematically shown with the inventive centralizer 20 shown in two places. Well screen 10 also has connected to it a coupling 11 which in the preferred embodiment is welded, weld 12, onto well screen tubing 10. Any connecting means to prevent the rotation of coupling 11 on well screen tubing 10 could be utilized. Well screen 10 can be any of several manufacturer's products. An example of such a well screen can be found on pages 4257–60 of Volume 3 of the 1982–83 Edition of the Composite Catalog of Oil Field Equipment and Services by WORLD OIL. Similar well screens may be composed of metal or non-metal or a combination of both. The wire shown in well screen 13 or insert 23 as used in the present description could be metal or non-metal.

Well screen centralizer 20 is connected to blank tubing section 15 by suitable connecting means such as welding. A second well screen 14 is shown connected to the coupling 11 and thereby to first well screen 10 by any suitable connector means such as threads.

Well screen tubing 10 along with other lengths of well screen is placed in a well bore (not shown) across from an oil, gas or water formation zone (not shown) to allow the fluids or gas to pass from the formation zone through the well screen portion 13 and into the longitudinal flow passageway 26 to begin flow to the surface (not shown) through suitable flow conductors (not shown).

Figure 2:
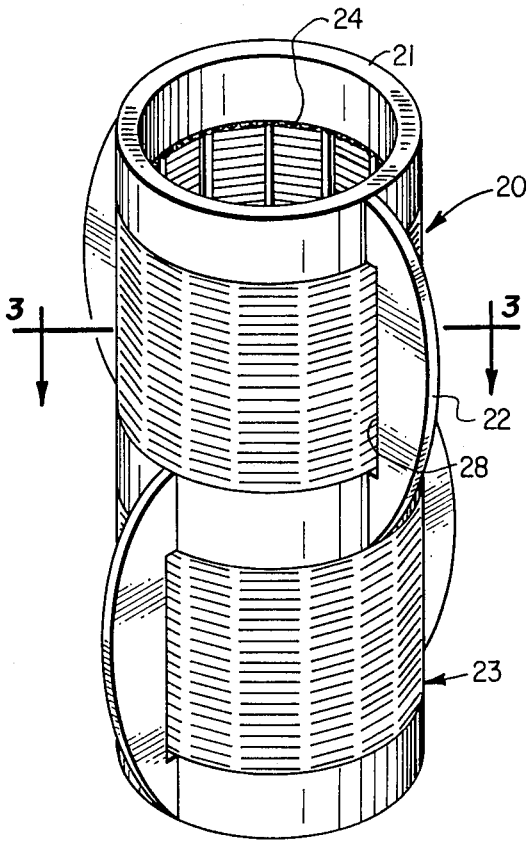
FIG. 2 shows an isometrical view of the well screen centralizer.
Figure 3:
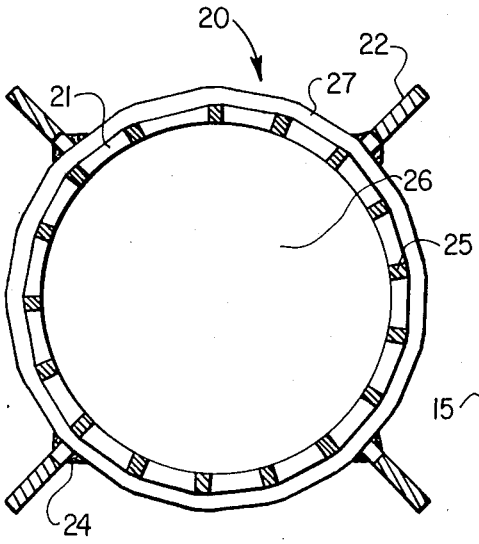
FIG. 3 is a cross-sectional view taken along line 3—3 of FIG. 2.

Referring to FIG. 2 and FIG. 3, the well screen centralizer 20 is shown in greater detail. The well screen centralizer 20 is connectable in well screen 10 by any suitable connecting means such as welding and is then a part of the well screen 10. The well screen centralizer 20 is comprised of a plurality of well screen inserts 23, a plurality of ring members 21 which may be round, as shown, or non-round and a plurality of centralizer fins 22. In the preferred embodiment the ring members 21 and the circumferentially spaced longitudinally extending centralizer fins 22 are made of one or more appropriate stainless steels in order to reduce corrosion between dissimilar metals. In between adjacent ring members 21 is inserted a well screen section or insert 23. In FIG. 2, two such inserts 23 are shown but more than two could be used if the appropriate amount of ring members 21 and centralizer fins 22 were added.

The ring members 21 and the well screen inserts 23 are axially aligned and are connected together by any suitable connecting means such as weld 24. The centralizer fins 22 connect the ring members 21 together in axial alignment and space the ring members 21 apart from each other. The fins 22 may be welded to the ring members 21, or the ring members 21 and the centralizer fins 22 may be integrally formed in one piece. An example of such forming is by casting.

FIG. 3 is a cross-sectional view and shows well screen insert rib wires 25 and the top of a wire wrap 27 which forms a part of the well screen insert 23. Also shown is fin weld 24 which secures the centralizer fins 22 to the ring members 21. As discussed before, the centralizer fins 22 and the ring members 21 could be cast in one piece in the axially aligned, spaced apart position shown in FIG. 2.

The well screen inserts or sections 23 could be inserted and secured between the ring members 21 prior to connecting or securing the centralizer fins 22 to the ring members. Also, the well screen insert 23 could be inserted and secured after the ring members 21 and the centralizer fins 22 are connected or secured to each other. The well screen inserts 23 are secured to the adjacent ring members 21 by welding, but other securing means could be used.

The radially extending centralizer fins 22 arch over the outer wall 28 of the well screen insert 23. This open space or arch 29 allows fluid flow under the centralizer fins 22 and around the outer wall 28 of well screen insert 23 to prevent turbulence and flow cutting.

Figure 4:
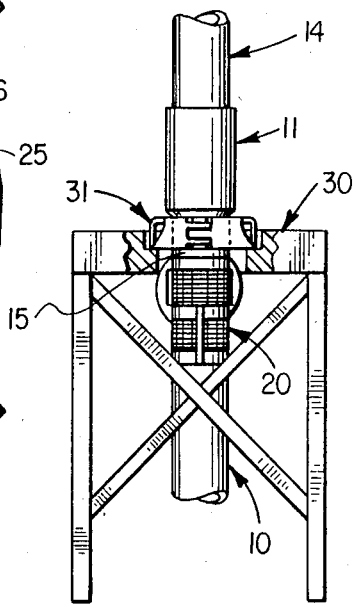
FIG. 4 is a schematic view showing a well screen being supported by a tubing clamp placed below a coupling, all of wnich is being supported by a well screen assembly and support stand.

Referring to FIG. 4, a first well screen 10 and a second well screen 14 connected together by any suitable connecting means such as coupling 11 are shown suspended in a well screen assembly and support means 30. Downward, longitudinal movement of well screens 10 and 14 is further restricted by a tubing clamp 31. In the preferred method, two such clamps are used and referred to as a first tubing clamp means and a second tubing clamp means. Tubing clamp means 31 is the same type of tubing clamp means used in supporting both well screen tubing 10 and 14, but different types of clamps could be used. A type of tubing clamp means that could be used is shown on pages 4544–45 of Volume 3 of the 1984–85 Edition of the Composite Catalog of Oil Field Equipment and Services by WORLD OIL. Other appropriate tubing clamps could be adapted for use.

In the preferred method for assembling and supporting one or more well screens together for use in a well bore, the following procedure is used. Prior to assembly of the well screens such as first well screen 10 and second well screen 14 to each other, the couplings 11 are placed on first well screen 10 and on second well screen 14, along with other well screens at the appropriate time, and the couplings 11 are secured by welding.

Enough blank tubing should be left between the lower end of the coupling 11 and the top of the well screen portion 13 of the well screen or between the lower end of the coupling 11 and the topmost ring member 21 to allow a first or second tubing clamp means 31 to be secured to the upper blank tubing section 15. First and second tubing clamps 31 should have an inside diameter smaller than the outside diameter of the coupling 11 in order to support the well screens 10 and 14 by preventing the coupling 11 from slipping through tubing clamp 31 once it is latched around the upper blank tubing section 15 of well screens 10 or 14.

Once first tubing clamp 31 is secured around the upper blank tubing section 15 of well screen 10, a lifting means (not shown) is attached to well screen tubing 10. The lifting means may be of any suitable type such as the elevator (not shown) that is shown on pages 4568–69 of Volume 3 of the 1984–85 Edition of the Composite Catalog of Oil Field Equipment and Services by WORLD OIL and may also include a lifting sub or lift sub (not shown) similar to that shown on page 6772 of Volume 4 of the same edition. If the elevator was not secured directly around the upper blank tubing section of the well screen, due to lack of sufficient length of the upper blank tubing section, a lift sub (not shown) would be connected to the coupling 11 and the elevator secured around the lift sub.

The first well screen 10 is then lifted and suspended above the well screen tubing assembly and support means or stand 30 once the assembly and support means 30 has been placed in line with the well bore (not shown). The first well screen 10 with the first tubing clamp 31 secured to it is then lowered through the assembly and support stand 30 until the first tubing clamp means 31 rests within the portion of the assembly and support means 30 provided to support and restrict it from further downward movement and to restrain rotational movement of the first tubing clamp 31. Well screen 10 is further lowered until the coupling 11 is resting on top of tubing clamp 31 and tubing clamp 31 is relatively supporting all the weight of well screen tubing 10 which is in turn supported by assembly and support stand 30. Tne lifting means described above is then removed from the first well screen 10.

In a manner similar to that described for the first well screen 10, a second tubing clamp means 31, with an inside diameter smaller than the outside diameter of the coupling 11 on the second well screen tubing 14, is then secured to the upper blank tubing section 15 just below coupling 11. The lifting means described above or any other suitable lifting means (not shown) is then attached to the second well screen tubing 14 and used to lift and suspend well screen 14 above well screen 10, now suspended in the well screen assembly and support means 30.

At this time, the first well screen 10 must be restrained from turning with a suitable antirotational means (not shown) attached to the coupling 11. Such an antirotational means could be a pipe or Stiltson wrench or a tool as shown on page 6255 of Volume 4 of the 1984–85 Edition of the Composite Catalog of Oil Field Equipment and Services by WORLD OIL or any other suitable means. Once well screen 10 is rotatively restrained, second well screen 14 may be lowered in contact with coupling 11 of first well screen 10 and second well screen 14 may be attached to coupling 11 of well screen 10 by any suitable means which is usually by threaded connection.

The lift means is then used to lift both well screens 10 and 14 until first tubing clamp means 31 is free of the well screen assembly and support means 30 shown in FIG. 4. Once free of assembly and support means 30, the first tubing clamp means 31 may be removed from around first well screen 10, and both the first well screen 10 and the second well screen 14 may be lowered through the well screen assembly and support means 30 until the second tubing clamp means 31 rests within the well screen assembly and support means 30 as did the first tubing clamp means 31 described above. The method is then repeated until all the desired well screens are lowered into the well bore.

The above method could be changed in sequence to allow the first or second tubing clamp means 31 to be placed between coupling 11 and the well screen centralizer 20 if a well screen centralizer 20 is part of either well screens 10 or 14. The method could be further changed to allow the first well screen 10 to be restrained after the second well screen 14 is lowered in contact with the coupling 11 of the second well screen 14. The method could be further changed in sequence to allow the lifting means (not shown) to be placed on the well screens 10 and 14 before the tubing clamp means 31 is secured to the upper blank tubing section 15.

The foregoing descriptions, methods and drawings are explanatory and illustrative only, and various changes in shapes, sizes and arrangement of parts as well as certain details of the illustrated contraction or method may be made within the scope of the appended claims without departing from the true spirit of the invention.

We claim:

1. A method for joining a tubular well screen section to a tubular production member comprising the steps:

attaching a first annular coupling member to the well screen section;

attaching a second annular coupling member to the tubular production member;

interposing a third annular coupling member in axially spaced relation between the first and second annular coupling members;

securing a first tubular screen insert between the first and second annular coupling members;

securing a second tubular screen insert between the second and third annular coupling members;

supporting the first and third annular coupling members in longitudinal flow path alignment with the first screen insert by first and second centralizer blades, with the first and second centralizer blades being circumferentially spaced and extending in bridging relation across the first screen insert; and, supporting the second and third annular coupling members in longitudinal flow path alignment with the second screen insert by third and fourth centralizer blades, with the third and fourth centralizer blades extending in bridging relation across the second screen insert and being circumferentially offset with respect to the first and second centralizer blades, respectively.

2. A method for joining a first tubular well screen section to a second tubular well screen section comprising the steps:

attaching a first annular coupling member to the first well screen section in flow path alignment therewith;

attaching a second annular coupling member to the second tubular well screen section in flow path alignment therewith;

attaching a third annular coupling member intermediate the first and second well screen sections and in flow path alignment therewith;

connecting the first and third annular coupling members together by first and second centralizer blades, with the first and second centralizer blades being circumferentially spaced and extending in bridging relation across the first well screen section; and, connecting the second and third annular coupling members together by third and fourth centralizer blades, with the third and fourth centralizer blades extending in bridging relation across the second well screen section and being circumferentially offset with respect to the first and second centralizer blades, respectively.

3. A method for constructing a well screen centralizer comprising the steps:

aligning first, second and third annular coupling members in axial relation;

securing first and second well screen inserts between adjacent annular coupling members; and, connecting adjacent annular coupling members together with first and second pairs of circumferentially spaced, longitudinally extending centralizer blades, with first and second centralizer blades of said first pair being circumferentially spaced and extending in bridging relation across the first well screen insert, and with first and second centralizer blades of said second pair extending in bridging relation across the second well screen insert, the first and second centralizer blades of said first pair and being circumferentially offset with respect to the first and second centralizer blades of said second pair, respectively.

4. A method for stabilizing first and second tubular well screen sections between first and second production tubing sections comprising the steps:

supporting the first and second production tubing sections in longitudinal flow path alignment;

interposing an annular coupling member intermediate the first and second production tubing sections;

securing the first tubular well screen section between the first production tubing section and the annular coupling member;

securing the second tubular well screen section between the second production tubing section and the annular coupling member;

supporting the first production tubing section and the annular coupling member in longitudinal flow path alignment with the first well screen section by first and second centralizer blades, with the first and second centralizer blades being circumferentially spaced and extending in bridging relation across the first well screen section; and, supporting the second production tubing section and the annular coupling member in longitudinal flow path alignment with the second well screen section by third and fourth centralizer blades, with the third and fourth centralizer blades extending in bridging relation across the second well screen section and being circumferentially offset with respect to the first and second centralizer blades, respectively.

* * * * *